United States Patent [19]

Boom et al.

[11] 3,966,590

[45] June 29, 1976

[54] MAGNETIC ORE SEPARATOR

[75] Inventors: Roger W. Boom; Yehia M. Eyssa, both of Madison, Wis.; John Sutton, South Holmwood near Dorking, England

[73] Assignee: The United States of America as represented by the Secretary of the Interior, Washington, D.C.

[22] Filed: Sept. 20, 1974

[21] Appl. No.: 508,013

[52] U.S. Cl. ..... 209/39; 209/214; 209/232; 209/478

[51] Int. Cl.[2] ..... B03C 1/30

[58] Field of Search ..... 209/39, 40, 214, 224, 209/223 R, 232; 210/222, 223, 478; 55/100

[56] References Cited

UNITED STATES PATENTS

| | | | |
|---|---|---|---|
| 736,298 | 8/1903 | Reed | 209/232 X |
| 1,012,488 | 12/1911 | Wedge | 209/232 X |
| 1,050,318 | 3/1913 | Bruck | 209/232 |
| 1,527,069 | 2/1925 | Peck | 209/214 |
| 2,372,321 | 3/1945 | Griffiths | 209/214 X |
| 2,937,710 | 5/1960 | Michael | 55/100 |
| 3,289,836 | 12/1966 | Weston | 209/214 |
| 3,498,455 | 3/1970 | Kirby | 209/223 |
| 3,503,504 | 3/1970 | Bannister | 209/232 X |
| 3,697,420 | 10/1972 | Blaisdell | 210/222 X |

FOREIGN PATENTS OR APPLICATIONS

| | | | |
|---|---|---|---|
| 275,912 | 8/1970 | U.S.S.R. | 209/39 |

*Primary Examiner*—Robert Halper
*Attorney, Agent, or Firm*—Gersten Sadowsky; Donald R. Fraser

[57] ABSTRACT

A radial magnetic field gradient applied from an elongated central source is traversed parallel to the elongation by a turbulent flow of a slurried mixture of magnetic and nonmagnetic components in the presence of a force thereon opposing in direction the attractive force of the magnetic field upon the magnetic components whereby the respective components are separated by the disparate forces and the flow acts to continuously advance the separation and direct separated components toward related collecting stations.

5 Claims, 6 Drawing Figures

MAGNETIC ORE SEPARATOR

The invention relates to magnetic separation of minerals, and more particularly to a separation in a continuous fluidized particulate feed thereof of magnetic particles, including weakly magnetic constituents, from nonmagnetic particles by turbulently streaming the feed through a high intensity magnetic field applied thereto.

Magnetic separation of fluidized particulate minerals for which a high intensity magnetic field is employed has heretofore been disclosed in U.S. Pat. No. 3,608,718, issued Sept. 28, 1971, to W. M. Aubrey, Jr., et al. Described in this patent is a vertically disposed conduit constituting a separation column which is surrounded at a portion thereof intermediate its ends by a horizontally disposed quadrupole magnet comprising four symmetrically arranged iron pole pieces having their faces lying parallel to the longitudinal axis of the column. Concentrically arranged within the column is an upper tubular baffle from which is spaced a lower tubular baffle, also concentrically arranged within the column, such that the inter-baffle space is found situated centrally between the aforementioned pole faces. Coaxial annular passages provided by the spaces between the upper baffle and the column and within the inner baffle are disposed to receive therethrough the fluidzed feed and a wash fluid, respectively. Other coaxial passages provided by the spaces within the lower baffle and between this lower baffle and the column are accordingly aligned beneath the upper passages of the column. These other passages are thereby in position to receive the outputs of a particle separation occurring about a conically tapered end portion of a rod longitudinally disposed on the column axis and extended through the upper baffle so as to locate such end portion in the inter-baffle space. Operation of the patented arrangement finds fluidized feed pumped into the upper baffle passage and wash water pumped into the annular passage coaxial therewith. As the fluidized material flows down around the rod the magnetic particles are attracted from the centrally moving stream and under the influence of the surrounding magnet such particles travel outwardly of the longitudinal axis of the column and into the stream of wash water from the upper annular passage provided therefor whereby these particles are carried down through the annular passage outside of the lower baffle. The centrally moving stream of fluidized material containing substantially only nonmagnetic particles leaves the column through the annular passage within the lower baffle. Also contemplated for the operation disclosed by this patent is a stream of wash fluid having a radial component directed inwardly and towards the longitudinal axis of the column so as to improve the efficiency of separation by more positively confining the nonmagnetic fraction, or tailings, to the central stream of fluidized material and to thereby prevent the tailings from being scattered into the stream of wash fluid carrying the magnetic particles out of the column.

Also disclosing a high intensity magnetic field applied to a slurry, or fluidized feed, to obtain a separation thereof into magnetic and nonmagnetic fractions, is a U.S. Pat. No. 3,503,504 issued Mar. 31, 1970, to J. D. Bannister.

A cylindrical drum-shaped housing of the patented arrangement has a cylindrical inner cavity in which a disk-shaped chamber is rotatably mounted in a central position thereof so as to provide feed flow space between inner surfaces of the housing and outer surfaces of the chamber. The rotatable chamber has positioned therein a hollow sector, filling approximately one quadrant of the chamber, which is mounted to remain stationary when the chamber rotates. Affixed within the hollow sector is a panel carrying an ordered array of superconducting coils which function in a supercooled helium atmosphere within the hollow section so as to provide a high intensity magnetic field through feed streaming across the chamber. Rotation given this chamber is intended to assist gravity in directing the fluidized flow from a feed entrance at the upper end of the housing to pass down over the sides of the chamber and through ing magnetic field thereat. A gangue exit located at the lower end of the housing in nearly a straight line path directly below the feed entrance of the housing receives the nonmagnetic fraction whereas the magnetic material is drawn to the sides of the rotating chamber by the high intensity force field extending thereto from the panel, and clings to the outside of the rotating chamber which carries such magnetic particles beyond the effective field of the panel to a point beyond the gangue exit and adjacent to a further exit where one or more high velocity streams of water are directed against the face of the revolving chamber to disengage the magnetic residue and cause it to flow through the further exit where it is collected.

Magnetic separation in accordance with the unique procedures of the present invention has the introduction of a slurry of particulate mineral substances occurring as a turbulent flow about a centrally disposed source of magnetic flux. A conducting cable arrangement having utility as a magnetic flux source for the invention is maintained on the longitudinal axis of an encircling conduit whereof an inner surface uniformly spaced from the cable defines therewith an annular channel. Slurry agitated by its turbulent flow through this channel carries the particles therein through the cable's magnetic flux such that the magnetic particles are attracted inwards by the magnetic field while nonmagnetic particles, or tailings, are unaffected. However, the turbulence of the slurry acts to prevent the sticking of particles upon the surfaces within the channel, but allows an effective magnetic separation by the interaction of gravity with the magnetic attraction upon the magnetic particles which compels such particles to freely discharge from near the inner perimeter of the channel adjacent the cable, whereas the nonmagnetic particles on which gravity acts alone or together with a centrifugal force of the turbulence undisturbed by magnetic forces, discharges from near the outer perimeter of the channel spaced away the cable. Particle guiding panels stationed in the plane distinguishing the difference in particle discharge are employed in a conventional manner to direct the different particles to appropriate collection receptacles. Advantages over the patented configurations previously described are manifest from the invention's use of turbulent flow which in cleaning the internal surfaces of the separator conduit avoids the use of wash fluids to facilitate collection of the fractions. Further, the centered magnetic flux source permits a more efficient use of larger conduit structures therewith and thus more economical flow rates for the slurry.

One of the objects of the invention is to provide improved method and apparatus for more rapidly and economically separating magnetic or magnetizable particles from nonmagnetic or relatively nonmagnetic particles.

Another object of this invention is to provide a more effective method and apparatus for beneficiation of particulate ore by its separation into magnetic and nonmagnetic particles in a turbulent flow thereof obtaining a self-cleaning action in developing the particle fractions.

A still further object of the invention is to provide a more efficient magnetic flux field gradient generation in a method and apparatus for beneficiation of ore by magnetic separation.

These and other objects of the invention will be more clearly understood from the following description of a preferred embodiment of the invention considered together with the accompanying drawing wherein.

Figure 6:
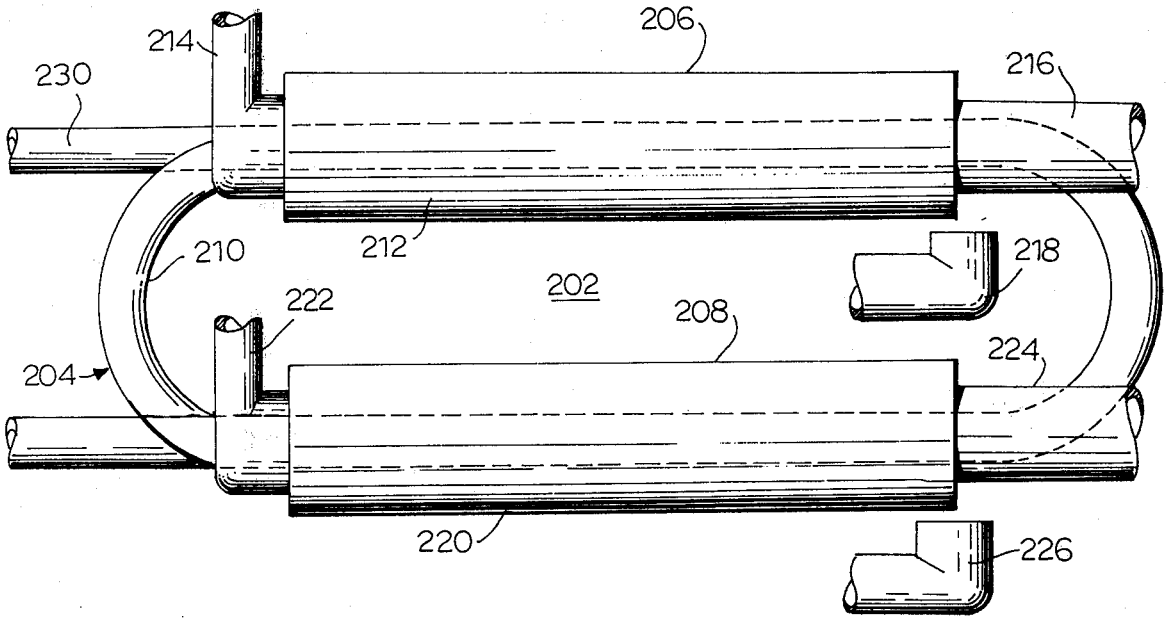
Figure 5:
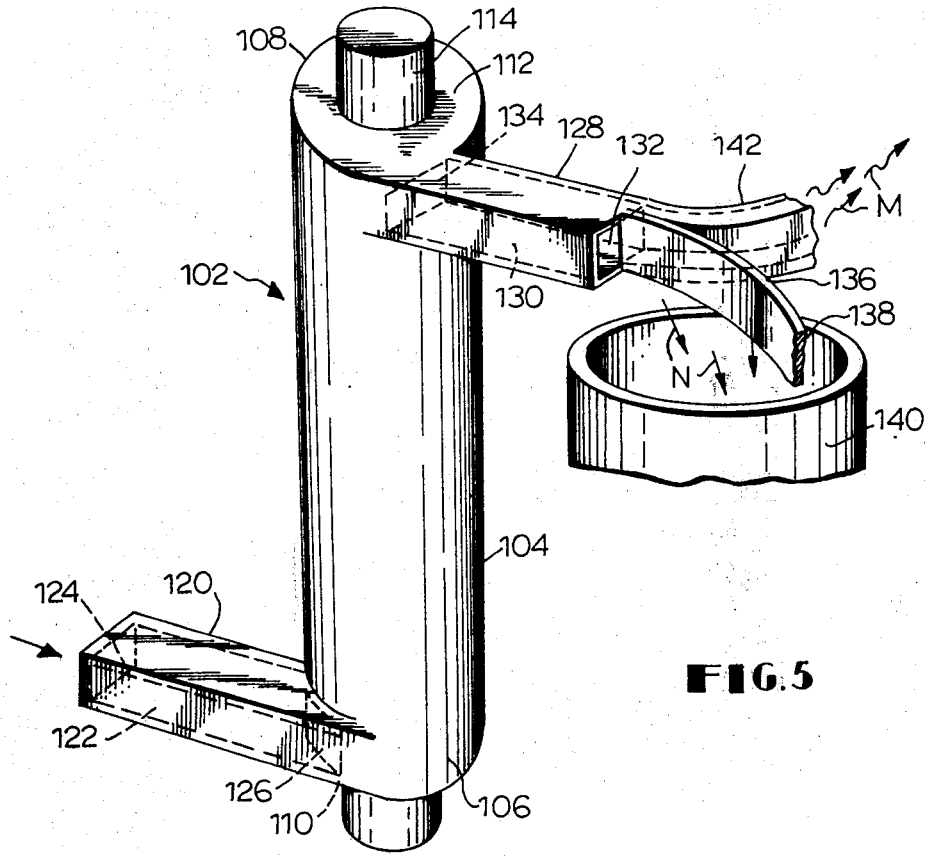
Figure 3:
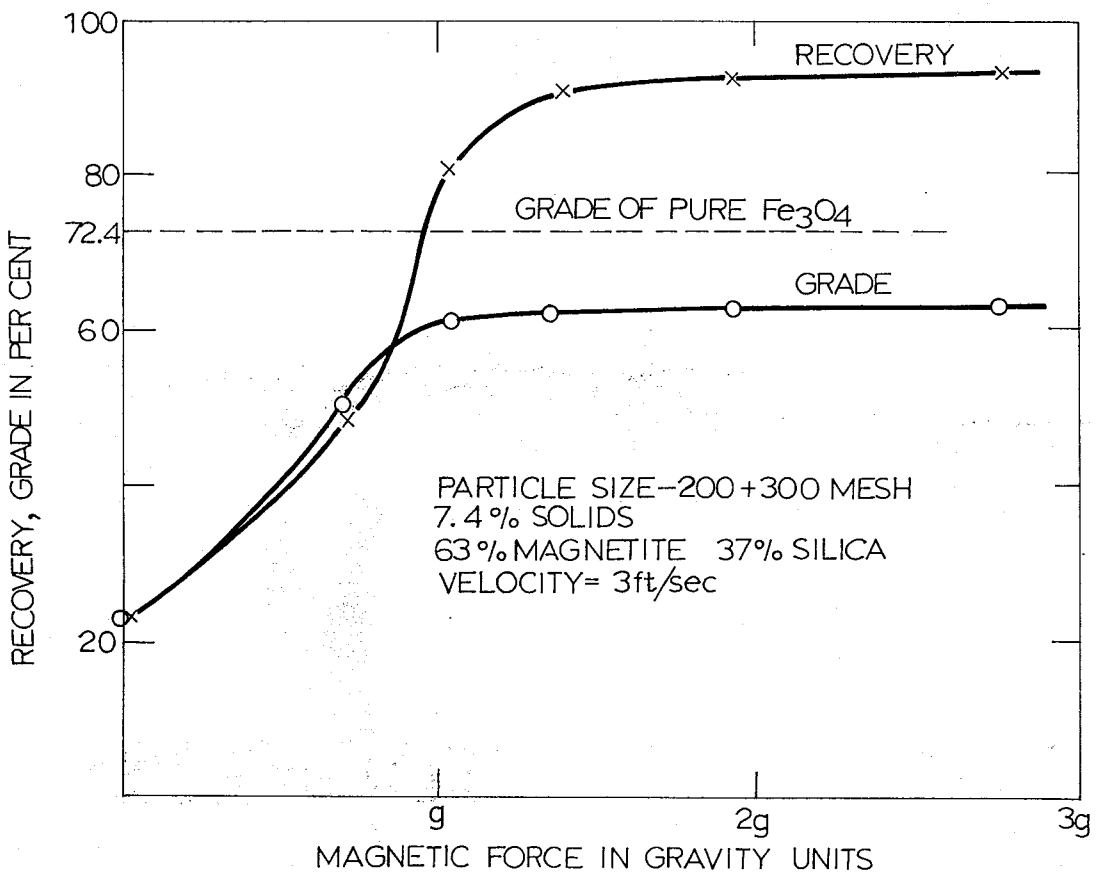
Figure 4:
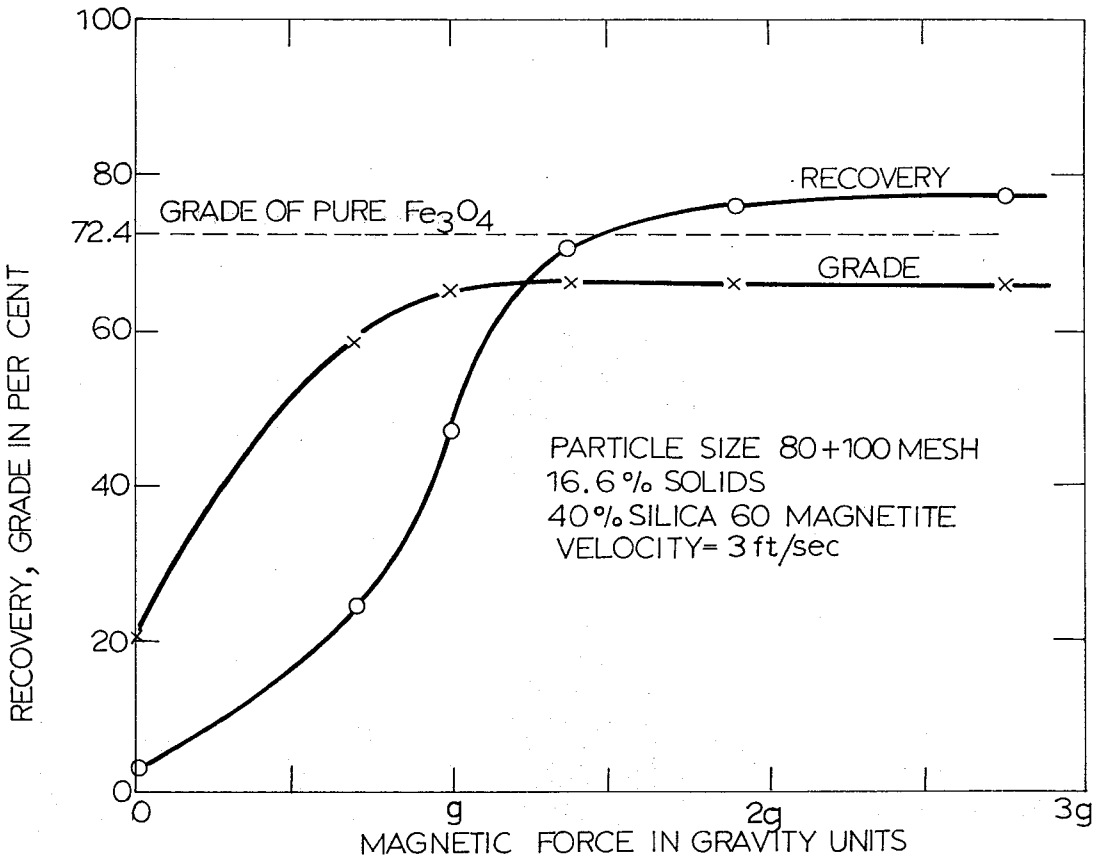

FIGS. 3 and 4 graphically represent percentage recovery and grade of iron ore separated with use of the invention through a range of magnetic forces employed therein;

FIG. 5 represents a view in perspective of another embodiment of the invention, and wherein phantom lines are used to indicate interior details; and FIG. 6 represents an elevational view of still another embodiment of the invention, and wherein phantom lines are used to indicate interior details.

Figure 1:
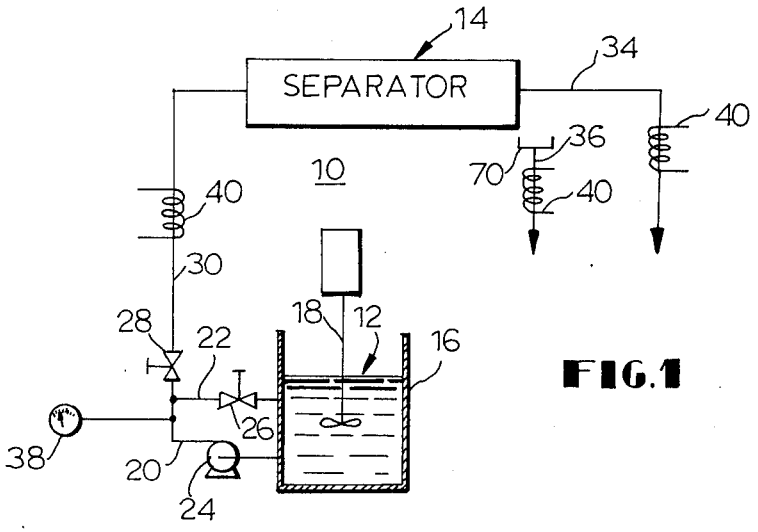
FIG. 1 represents diagrammatically a mineral beneficiation system employing the magnetic separator of the present invention.

In the diagrammatic showing of FIG. 1, basic components of a mineral beneficiation system 10 are seen as including a slurry source 12, a magnetic separator 14, and fluid flow conduits operatively interconnecting source to separator, and providing exit channels for the system output. A mixing tank 16 of the source is supplied with pulverized mineral matter, such as tailings of iron ore mining, and a fluid, such as water. Adapted for use in this tank is a mixer 18 which operates in a conventional manner to fluidize the comminuted mineral matter in the fluid supplied, and to maintain the resultant suspension or slurry by preventing settling out of its particles. Parallel conduits 20 and 22, having operatively connected therein a high velocity slurry pump 24, and a valve 26, respectively, communicate low situated openings in tank 16 with a feed valve 28. Communicating separator 14 with the aforementioned conduits to the tank is a conduit 30 leading from valve 28 to an inlet of separator 14. Ore concentrate and tailing residue are carried from the separator in further conduits 34 and 36, respectively to suitable collection stations indicated by A and B, respectively. Flow rates present in conduit 30 are established by regulation of the by-pass flow secured by adjustments of valve 26 in coordination with settings of valve 28. The capacity of the flow rate depends on the size of the system which for example may have a flow channel one inch by one half inch in cross-section requiring velocities from between 2 to 6 feet per second. Regulation is based on flow rate and magnetic material concentrations measured in conduits leading to and from separator 14 by flowmeter 38 and other meters represented by coils 40 in FIG. 1.

Figure 2:
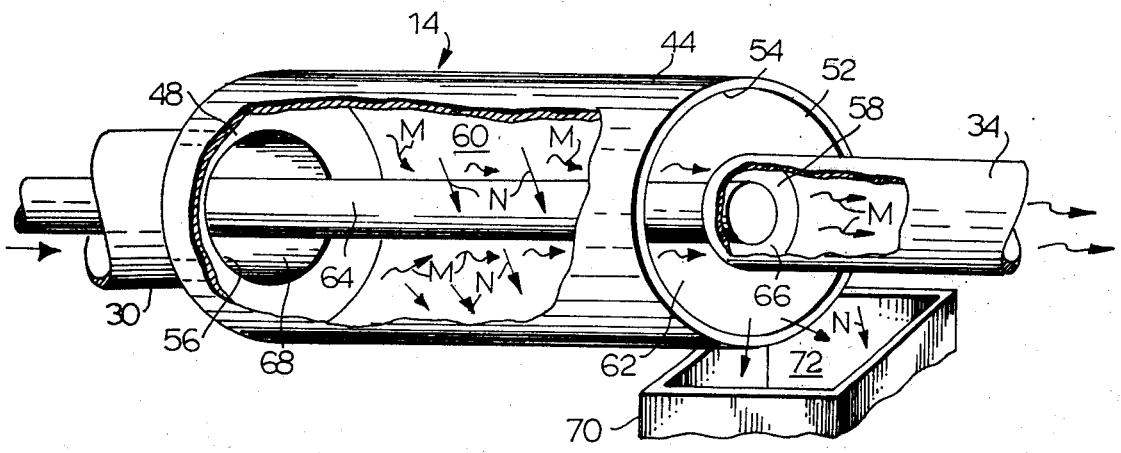
FIG. 2 represents a view in perspective of one embodiment of a magnetic separator according to the present invention wherein outer structural elements are partially broken away to show interior details of the separator.

Reference is now also made to FIG. 2, and its showing of separator 14 in additional detail, to more fully explain the unique mineral beneficiation to be achieved in accordance with the present invention. Providing the basic housing for separator 14 is a horizontally disposed elongated hollow cylindrical shell 44, made of 304 or 316 stainless steel or the like, having at one end thereof a circular planar wall 48, which extends perpendicular to the longitudinal axis of the cylindrical structure, and at its other end an opening 52 defined by the peripheral edge 54 of its cylindrical structure. Affixed centrally at wall 46 to an axial opening 56 therein, is conduit 30. Maintained centrally at opening 52, so as to be concentrically situated with respect to edge 54 thereof, is a terminus of conduit 34 having an opening 58 which thereby faces chamber 60 constituted by the hollow of shell 44. A circular channel 62, defined between the outer surface of conduit 34 and the inner peripheral surface of shell 44, which then remains of shell opening 52, thus surrounds the passage through conduit opening 58. A cylindrical cable 64 longitudinally disposed on the axis of shell 44 extends centrally through chamber 60 and reaches conduit opening 58 whereat a further circular channel 66 is defined between the outer surface of cable 64 and the inner peripheral surface of the conduit opening. Cable structure 64 projects into and through conduit 30 wherein it traverses a central portion thereof so as to enter chamber 60 by way of shell opening 56 and define between the outer surface of the cable and the inner peripheral surface of opening 56 a still further circular channel 68. Positioned directly beneath the open end of shell 44 is a receptacle structure 70 to which collection conduit 36 is connected. Structure 70 provides a passage 72 having a relatively wide opening located in the path of slurry residue caused to issue through channel 62 in a manner to be hereinafter more fully explained.

In practicing the present invention employing the embodiment of the separator shown in FIG. 2, mixing tank 16 is supplied with pulverized mineral material, such as low grade weakly magnetic iron ore, along with water, and mixer 18 made operative to fluidize the contents of the tank. With valve 28 opened, and valve 26 appropriately adjusted, pump 24 functions to move a high velocity stream of fluidized comminuted mineral material from source 12 to conduit 30. Electrical circuitry connected to energize that part of cable 64 within separator 14 is made operative in a conventional manner and gives rise to a high intensity magnetic field which extends radially toward the cylindrical wall of shell 44 over the length of the cable within the shell. The stream of fluidized material in conduit 30 flows through circular channel 68 and swirls past cable 64 as it traverses chamber 60 toward end opening 52 of shell 44. Magnetic and magnetizable particles in the fluidized stream respond to the radial magnetic field around cable 64 in chamber 60, by moving toward the cable as indicated in FIG. 2 by the plurality of curved arrows M. On the other hand, nonmagnetic particles passing through circular channel 68, which initially move ahead with the force of the stream, commence to sink when progressing in an axial direction through chamber 60 as indicated by straight arrows N in FIG. 2. Hematitic ore particles having sizes down to 20 micron can be deflected and separated, but other ores with magnetic moments 1 em$\mu$/gm or greater could also be separated. Diminished forward velocity of the stream in its path through the larger cross-sectional area of chamber 60, as compared to the cross-sectional area at channel 68, accentuates the tendency of nonmagnetic particles to turn toward the lower part of the chamber. Accordingly, as any part of the slurry moves closer to chamber opening 52 separation of magnetic and magnetizable particles from nonmagnetic particles therein goes further towards completion.

In spite of the intensification of the magnetic field acting on magnetic particles being drawn thereby to bear closer to elemental areas on the surface of cable 64 in the chamber, these particles do not actually adhere to such areas but are instead swept along with the movement of the slurry stream in the same way as nonmagnetic particles are carried through chamber 60 along the lower section of the chamber's cylindrical surface. As a result all particles, whether parting or separated from one another, maintain concurrent movement through the separator wherefore the turbulent motion taken by the slurry stream acts to automatically clean the mineral fractions from the internal surfaces exposed thereto. Therefore, mineral separation in accordance with the present invention can be free from a need for intermittent wash water sequences to clear particle fractions from the separator. When reaching the end of chamber 60 contiguous to its opening 52, the stream therethrough carries fully defined fractions of the mineral material which are propelled by the velocity of their carrier toward the diverting structure of separator 14 manifested by the terminus of conduit 34 at chamber opening 52. As a consequence, the magnetic and magnetizable fraction swirling around cable 64 is swept beyond the cable so as to pass through circular channel 66 and into conduit 34 wherein either gravity or a suction becomes applicable to draw this fraction into collection station A. Moreover, a distinct nonmagnetic fraction having been also swept through chamber 60 is thereupon propelled through circular channel 62 and falls freely by way of collector passage 72 and conduit 36 into collector station B. Indicative of recoveries from the separation procedure heretofore described are the results thereof presented by the showings in FIGS. 3 and 4.

In the embodiment of the present invention appearing in FIG. 5, a separator 102 is characterized by a vertically disposed elongated cylindrical basic housing 104. A hollow chamber defined by the internal surface of housing 104 is effectively closed at its lower end 106, and at its upper end 108, by planar walls 110 and 112, respectively, which are perpendicular to the longitudinal axis of housing 104. Corresponding openings centered in these closure walls where such openings are axially aligned on the axis of housing 104, have fitted through them a cable structure 114. Electrical energizing circuitry, not shown, connected to this cable structure is operative in a conventional manner to give rise to a radially directed intensified magnetic field within the chamber of housing 104. A rectangular conduit 120, comprising as the underside thereof an extension of wall 110, is an integral part of housing 104 at lower end 106 thereof where the conduit joins the housing to provide a tangential passage 122 thereto having an outer opening 124, and an inner port 126 opening in the cylindrical wall of the housing's chamber. Similarly, a rectangular conduit 128, comprising as the topside thereof an extension of wall 112, in an integral part of housing 104 at upper end 108 thereof where this conduit joins the housing to provide a tangential passage 130 thereto having an outer opening 132, and an inner port 134 opening in the cylindrical wall of the housing's chamber. Ports 126 and 134 are each of sufficient width to span the radial distance between the outer surface of the cable part within the housing chamber and the inner wall of this chamber. In addition, upper conduit opening 132 is characterized by a flow diverting structure 136 which bisects the exit from this opening into horizontally aligned paths. Thus, a flow path starting in the housing chamber at near the cylindrical wall thereof extends through conduit 128 to an outer half of opening 132 wherefrom the path is further defined by a vertically disposed deflection plate 138 of structure 136. Plate 138 extends from a connection thereof at the bisection of opening 132 by curving outwardly over the opening in a collection receptacle 140. A further flow path starting in the housing chamber at near the outer surface of the cable therein extends through conduit 128 to an inner half of opening 132 and is further defined by a reduced conduit 142 made integral with conduit 128 so as to extend therefrom at the aforesaid inner half opening thereof. Conduit 142 curves away from plate 138 to join further extensions which lead the passage therein to a recovery collection station.

The FIG. 5 embodiment of the invention is also operative in a mineral beneficiation arrangement such as appears in FIG. 1. Slurry to be processed is pumped at a relatively high rate in a line, such as conduit 30, and thereby conveyed to conduit 120 by way of its opening 124. Upon flowing through conduit passage 122 the slurry traverses port 126 and enters the housing chamber tangentially wherefore it is directed into a high velocity circular path by the cylindrical wall of the chamber. Slurry thus caused to swirl rapidly about in the annulus defined between the inner wall of the chamber and the outer surface of the cable centered therein rises rotatively in the chamber and ultimately reaches port 134 at upper conduits 128. However, magnetic and magnetizable materials in the swirling stream are attracted centrally toward the cable structure by the magnetic force of the high intensity field gradient radiating from the cable. On the other hand, the swirl of the slurry stream develops a centrifugal force on the particles therein which, although ineffective to overcome the centerwise drift of magnetic materials thereof due to the magnetic attraction, is effective on the nonmagnetic materials thereof to impart thereto a radially outward thrust directing them toward the chamber wall. The resultant separation of centrally drawn magnetic materials from the outward thrust nonmagnetic materials progresses to completion as the stream slurry moves upward in the chamber. Therefore, when this stream has carried the materials therein to upper port 134, its exit tangentially from the chamber into conduit passage 130 conveys distinct fractions of magnetic and nonmagnetic particles which course through the passage from the inner and outer perimeters of the chamber's spatial annulus, respectively. Consequently, the magnetic particles in passage 130 flow through the half of conduit opening 132 which leads to conduit 142, and, as indicated in FIG. 5 by curved arrows M, is directed to a recovery station for the magnetic fraction, whereas the nonmagnetic particles in passage 130 flow through the adjacent half of opening 132, and, as indicated by straight arrows N, are deflected by impact on curved plate 138 into an open passage of collector receptacle 140.

Embodiments of the invention disclosed herein with reference to FIGS. 2 and 5 are also adapted to utilize superconductive magnetic components. This form of the invention has as its cable part within the separator, such as cable 64 inside of shell 44, or cable 114 inside of shell 104, a cryogenic superconducting magnetic structure of conventional construction. Typically comprising such structure at its axial core is a conducting wire, made of nobium-tin, or nobium-titanium, having concentrically disposed thereon in successive layers an inner hollow sleeve in which liquid helium is maintained, and an outer hollow sleeve which is maintained evacuated to provide requisite insulation for the arrangement. This superconduct-magnet is energized with a high current, low voltage power supply which at a voltage of 4 to 10 volts would typically provide a current density of $2 \times 10^4$ amperes/cm$^2$. A fuller understanding of the superconductivity made applicable herein is available in Proceedings of the 1968 Summer Study on Superconducting Devices and Accelerators, Part III, Brookhaven National Laboratory, BNL-50155 (C-55).

In the embodiment of the present invention appearing in FIG. 6, a separator apparatus 202 is shown as distinguished by the utilization therein of a superconducting magnetic field producing structure 204. Otherwise the apparatus is in effect a dual construction of separators which individually take the approximate form of the separator embodiment disclosed herein with reference to FIGS. 1 and 2, but wherein upper and lower separator components 206 and 208, respectively, are operatively associated by way of a magnetic field producing loop 210 of structure 204, which thereby serves to provide a high intensity magnetic flux field in each component. Component 206 thus has as parts thereof a horizontally disposed elongated hollow cylindrical shell 212 with which are operatively associated a slurry feed conduit 214 at one end thereof, and particle recovery and collecting elements 216 and 218, respectively, at the opposite end thereof. Component 208 is correspondingly constructed to provide therefor a hollow shell 220, a slurry feed conduit 222, and particle recovery and collecting elements 224 and 226, respectively. In operation each of the separator components 206 and 208 functions in the manner heretofore disclosed in connection with the embodiment explained with reference to FIGS. 1 and 2. Accordingly, a slurry stream entering a separator component through the feed conduit thereof is subjected to gravitational and magnetic field forces acting in opposition therein to effectuate a separation wherein magnetic and magnetizable particles of the stream are caused to exit through the component's recovery conduit and nonmagnetic particles drop from an end opening of the component into the collecting element provided therefor. A highly intensified magnetic flux field in the respective components is enabled by supercurrent flowing through centrally disposed magnetic field producing sections therein which constitute serially connected portions of loop 210. Loop 210 is in essence a singular superconducting cable structure 230 having several turns such that the total magnetic flux it would make available is proportional to the number of turns times the current therein. As was explained for the cables previously disclosed, cable 230 comprises a conductor confined within a cryogenic enclosure to which liquid helium is supplied, and is further constituted by the superinsulation of a vacuum jacket. Leads to cable 230 from an electrical energizing circuit supply the cable with a requisite current.

While preferred forms of the invention have been illustrated and described herein it will be understood that the invention is not limited thereby, but is susceptible to change in form and detail.

We claim:

1. A method for separating magnetic components from material containing a mixture of magnetic and nonmagnetic components wherein said components are comminuted and slurried by mixing with a fluid, comprising activating a radially directed magnetic field from a stationary magnetic flux source thereof which is extended distributed longitudinally from an initial point to a terminal point, directing said slurry in a turbulent flow thereof from said initial point toward said terminal point and about said source as a center, and substantially perpendicular to the radial direction of said magnetic field, in an environment where said components of the mixture are subject to forces acting in a direction opposite to that of magnetic attraction on said magnetic components of said slurry mixture, maintaining said magnetic field at a strength which overcomes said oppositely directed forces as said forces bear on said magnetic components, and draws said magnetic components toward said source, maintaining said turbulent flow at an intensity which at substantially all points in said flow of slurry between said initial and terminal points counteracts said forces drawing said magnetic components, including said magnetic attraction thereon tending to retain said magnetic components at said source, and modifies said forces on said nonmagnetic components, including said oppositely directed forces thereon, tending to dispel said nonmagnetic components away from said source, whereby said magnetic and nonmagnetic components are continuously maintained free-flowing in said flow between said initial and terminal points and carried across said magnetic field toward said terminal point, and concurrently separated one from the other into fractions taking disparate paths through said turbulent flow by said attraction of said magnetic components toward said centered source of magnetic flux and by said dispersion of said nonmagnetic components away from said centered source in response to said oppositely directed forces thereon, and collecting separately said magnetic and nonmagnetic components at respective stations which are differently disposed therefor within extensions of said disparate paths beyond said terminal points.

2. Apparatus for separating magnetic components from material containing a mixture of magnetic and nonmagnetic components where said components are comminuted and slurried by mixing with a fluid and conveyed in said slurry by a turbulent flow thereof, said apparatus comprising an elongated housing having first and second openings, a stationary source of magnetic flux centered in said housing and extending the length thereof, first and second conduit means communicating with said first and second openings, respectively, said housing being disposed to receive therein by way of said first end opening thereof said mixture in turbulent flow around said source which maintains said components free-flowing in said flow between said first and second end openings while said components are subjected to said magnetic force arising from said source and to a further force arising from said turbulent flow in directional opposition to said magnetic force whereby magnetic components of said slurry are attracted toward said source and separated from said nonmagnetic components which are drawn away from said source by said further force,-and wherein said turbulent flow is further effective in said housing to sweep said separated components out of said housing by way of said second opening thereof and said second conduit means communicating therewith said magnetic components passing out thru said second conduit means, said non-magnetic components passing out thru said opening outside said second conduit means.

3. The magnetic separation apparatus of claim 2 wherein said source of magnetic flux is a superconducting conducting cable which is confined within a cryogenic enclosure.

4. Apparatus for separating magnetic components from material containing a mixture of magnetic and nonmagnetic components wherein said components are comminuted and slurried by mixing with a fluid and conveyed in said slurry by a turbulent flow thereof, said apparatus comprising an elongated hollow housing constituted of a horizontally disposed cylindrical shell having a first end opening, and a second end opening defined by a peripheral edge of said shell, first and second conduit means communicating with said first and second openings, respectively, for which said second conduit means is disposed at said second end opening on the longitudinal axis of said shell whereby a spatial opening defined between said second conduit means and said peripheral edge constitutes a channel, a stationary source of magnetic flux constituted of a conducting cable disposed on the longitudinal axis of said shell and extending the length thereof, said shell being disposed to receiver therein by way of said first end opening thereof said mixture in turbulent flow around said source, and subject said components to said magnetic force arising from said conducting cable and to a further force in a directional opposition to said magnetic force whereby magnetic components of said slurry are attracted toward said conducting cable and separated from said nonmagnetic components which are drawn away from said source by said further force, and wherein said turbulent flow is effective in said shell to maintain said components free-flowing in said flow between said first and second openings and to sweep said separated components out of said shell such that said nonmagnetic components and fluid of said slurry mixture is swept from said shell by way of said channel concurrently with a sweeping of said magnetic components in fluid of said slurry from said shell by way of said second conduit means.

5. Apparatus for separating magnetic components from material containing a mixture of magnetic and nonmagnetic components wherein said components are comminuted and slurried by mixture with a fluid and conveyed in said slurry by a turbulent flow thereof, said apparatus comprising an elongated hollow housing constituted of a vertically disposed cylindrical shell having first and second end openings, a first channel joined tangentially to said shell by way of said first end opening constituted of an input aperture through said shell which communicates the hollow of said shell with said first channel, a second channel joined tangentially to said shell by way of said second end opening constituted of a further aperture through said shell which communicates the hollow of said shell with said second channel, and said second channel having in addition dual flow paths for facilitating segregation of separated magnetic and nonmagnetic components of said slurry, an electrically energized stationary cable disposed on the longitudinal axis of said housing and extending the length thereof, said cable constituting a source of magnetic flux giving rise to a magnetic force extending radially across said hollow of said shell, and said slurry entering said hollow through said input aperture thereof is swirled around said cable in an annulus defined between said cable and an inner cylindrical wall of said shell wherefore said components are subjected to said magnetic force and a centrifugal force developed by said swirling slurry while said components are maintained free-flowing in said slurry between said first and second end openings, and said further aperture receiving there through a tangential flow of said magnetic components in said fluid from adjacent said cable, and concurrently therewith a tangential flow of nonmagnetic components in said fluid from adjacent said inner cylindrical wall whereby said magnetic components are directed to one of said dual flow paths extending from an area adjacent said cable, and said nonmagnetic components are directed to another of said dual flow paths extending from an area adjacent said inner cylindrical wall.

* * * * *